US007242310B2

(12) United States Patent
Hotton et al.

(10) Patent No.: US 7,242,310 B2
(45) Date of Patent: Jul. 10, 2007

(54) CONTROL TECHNIQUES FOR SHUT-OFF SENSORS IN FUEL-FIRED HEATING APPLIANCES

(75) Inventors: Bruce A. Hotton, Montgomery, AL (US); Walter T. Castleberry, Pike Road, AL (US); William T. Harrigill, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 194 days.

(21) Appl. No.: 11/117,138

(22) Filed: Apr. 28, 2005

(65) Prior Publication Data

US 2006/0244618 A1 Nov. 2, 2006

(51) Int. Cl.
*G08B 17/10* (2006.01)

(52) U.S. Cl. ..... 340/632; 340/501; 340/577; 340/581; 340/584; 340/588; 122/14.2; 122/14.31

(58) Field of Classification Search ..... 340/632, 340/577, 578, 581, 584, 588, 501; 122/13.01, 122/14.1, 14.2, 14.31; 431/6, 22, 25
See application file for complete search history.

(56) References Cited

U.S. PATENT DOCUMENTS

| | | | | |
|---|---|---|---|---|
| 3,984,976 | A | | 10/1976 | Nagai |
| 4,030,462 | A | | 6/1977 | Sasayama et al. |
| 4,131,413 | A | | 12/1978 | Ryno |
| 4,364,227 | A | | 12/1982 | Yoshida et al. |
| 4,502,444 | A | | 3/1985 | Rubbo et al. |
| 4,565,519 | A | | 1/1986 | Carignan |
| 5,120,214 | A | * | 6/1992 | West et al. ..... 431/12 |
| 5,255,512 | A | | 10/1993 | Hamburg et al. |
| 5,359,852 | A | | 11/1994 | Curran et al. |
| 5,526,280 | A | | 6/1996 | Consadori et al. |
| 5,838,243 | A | * | 11/1998 | Gallo ..... 340/632 |
| 6,025,788 | A | * | 2/2000 | Diduck ..... 340/870.16 |
| 6,282,888 | B1 | | 9/2001 | Sealy et al. |
| 6,356,199 | B1 | * | 3/2002 | Niziolek et al. ..... 340/579 |
| 6,390,028 | B1 | | 5/2002 | Langmead et al. |
| 6,412,447 | B1 | | 7/2002 | Trant et al. |
| 6,626,133 | B2 | | 9/2003 | Schell et al. |
| 6,662,757 | B2 | | 12/2003 | Lesage |
| 2004/0200722 | A1 | | 10/2004 | Starling et al. |
| 2004/0204920 | A1 | | 10/2004 | Zimmermann et al. |

* cited by examiner

*Primary Examiner*—Hung Nguyen
(74) *Attorney, Agent, or Firm*—Haynes and Boone, LLP

(57) ABSTRACT

In a flammable vapor sensor-based shut-off system of a fuel-fired water heater the sensor resistance output signal degradation caused by aging of the sensor is automatically compensated for using an operational timer having an output signal indicative of the total life of the sensor subsequent to its installation on the water heater. In one embodiment of the system, a resistance adjustment signal having a magnitude related in a predetermined manner to the timer output signal is created and added to the sensor resistance output signal. In another embodiment, the timer output signal is used to appropriately adjust the minimum-maximum received sensor signal magnitude range, based on the installed age of the sensor, which will preclude combustion in the appliance. Additionally, in each embodiment thereof the system is provided with an improved initial minimum-maximum sensor signal magnitude range. Other types of shut-off gas sensors may be alternatively utilized.

26 Claims, 3 Drawing Sheets

CONTROL TECHNIQUES FOR SHUT-OFF SENSORS IN FUEL-FIRED HEATING APPLIANCES

BACKGROUND OF THE INVENTION

The present invention generally relates to the control of fuel-fired heating appliances and, in representatively illustrated embodiments thereof, more particularly provides improved control techniques for shut-off sensors, such as flammable vapor sensors, in fuel-fired heating appliances such as water heaters.

Over the past several years various proposals have been made for protecting fuel-fired heating appliances, such as water heaters, from flammable vapor ignition problems using sensors operable to shut down combustion in the appliance when flammable vapors, such as gasoline fumes, are detected near the appliance. Shut-off systems of this type have been proposed to terminate further combustion air flow to the appliance or to terminate further fuel flow thereto.

One design issue presented by this use of flammable vapor sensors is that the strength of their sensing output signal for a given concentration of sensed flammable vapors tends to diminish over time as the sensor "ages". Since the typical flammable vapor sensor used in this application normally stands idle for years without ever being exposed to flammable vapors of any sort, the strength of its output signal for a given concentration of sensed flammable vapor can become significantly degraded by the time (if ever) the sensor is called upon to shut down combustion in its associated heating appliance. Since the heating appliance control system typically prevents the sensor from terminating combustion (or preventing combustion initiation) in the appliance until the strength of the flammable vapor sensor output signal reaches a predetermined magnitude, the aging degradation of the sensor output signal in effect undesirably raises the concentration of flammable vapors that the sensor must be exposed to before the sensor shuts off or prevents initiation of combustion in the appliance that it protects.

Another design issue presented by the flammable vapor sensor shut-off control of a fuel-fired water heater or other type of fuel-fired heating appliance (such as a furnace or boiler) is associated with the establishment of a "range" of detected flammable vapor concentrations in which the sensor will shut down the fuel-fired heating appliance with which it is operatively coupled.

For example, the typical flammable vapor sensor used in conjunction with a fuel-fired water heater is a chemiresistor type sensor which outputs an electrical resistance signal indicative of the resistance of the sensor which automatically varies as a function of the concentration of flammable vapors to which the sensor is being exposed to. Water heater industry standards with respect to this type of flammable vapor sensor have been established and set forth a combustion shutoff range of sensor resistance output signals extending from a minimum resistance output signal magnitude of approximately 2-3 kΩ to a maximum resistance output signal magnitude of approximately 50 kΩ. Unless the resistance signal from the flammable vapor sensor is within this standard range, the control system with which the sensor is operatively associated will not permit a sensor-based combustion shutdown of the controlled appliance.

This industry standard lower limit is designed to prevent an "override" of the sensor via a jumper or the like, while the upper limit is designed to provide a trip point to indicate the detection of flammable vapors. However, in practice it has been found that this standard flammable vapor sensor output signal magnitude range is not totally satisfactory because it does not account for the speed of response for low end resistance due to temperature, etc.

From the foregoing it can seen that it would be desirable to provide improved control techniques for shut-off sensors in fuel-fired appliances such as water heaters. It is to this goal that the present invention is primarily directed.

SUMMARY OF THE INVENTION

In carrying out principles of the present invention, in accordance with representatively illustrated embodiments thereof, improved control techniques are provided for use in conjunction with a fuel-fired heating appliance having a combustion shut-off system in which a sensor generates an age-degradable output signal indicative of its detection of an undesirable gas or other substance and usable to preclude combustion in the appliance. From a broad perspective, the accuracy of the combustion shut-off system is improved using a method comprising the steps of providing a timer operable to output a time signal indicative of the total time the sensor has been operatively associated with the appliance, and utilizing the time signal to compensate for age-created inaccuracy in the sensor output signal.

In one representative embodiment of the method, the utilizing step is performed using the steps of combining the time signal and the sensor output signal to create a time-adjusted output signal, and utilizing the time-adjusted output signal to preclude combustion in the appliance. The method preferably comprises the additional step of setting minimum and maximum signal magnitudes between which the magnitude of the time-adjusted sensor output signal must fall to preclude combustion in the appliance. Illustratively, the time-adjusted output signal is an electrical resistance signal. According to a feature of the invention, an improved signal magnitude range is provided in which the minimum signal magnitude setting is within the range of from approximately 6 kΩ to approximately 10 kΩ, and preferably about 8 kΩ, and the maximum signal magnitude setting is within the range of from approximately 90 kΩ to approximately 110 kΩ, and preferably about 100 kΩ.

In a second representative embodiment of the method, the combustion shut-off system is initially provided with the aforementioned minimum and maximum signal magnitude settings, but the time signal is not used to modify the sensor output signal. Instead, the time signal is used to modify, over time, the originally established minimum and maximum signal magnitude settings so that they "track" the age-created degradation in the sensor output signal.

The sensor preferably detects changes in concentration of an undesirable gas or other substance and outputs a variable signal in response to such detection. In preferred versions of each of the aforementioned two representative embodiments of a combustion shut-off method, in which a combustion shut-off signal magnitude range is initially established, the time signal is used to compensate for age-created changes in the sensor output signal magnitude in a manner maintaining a predetermined relationship between the concentration of the detected substance and the sensor-based preclusion of combustion within the appliance.

Illustratively, the fuel-fired appliance is a fuel-fired water heater having a fuel supply valve, the sensor is a chemiresistor type flammable vapor sensor operative to output a variable electrical resistance signal, and the combustion shut-off system is operable to close the fuel supply valve under the control of the sensor.

However, the invention is not limited to water heaters, and principles of the invention could also be utilized in conjunction with other types of fuel-fired heating appliances such as, for example, boilers and furnaces. Also, a variety of other types of sensors, such as carbon monoxide sensors, and sensors having different types of output signals, could be utilized without departing from principles of the present invention.

DETAILED DESCRIPTION

Figure 1:
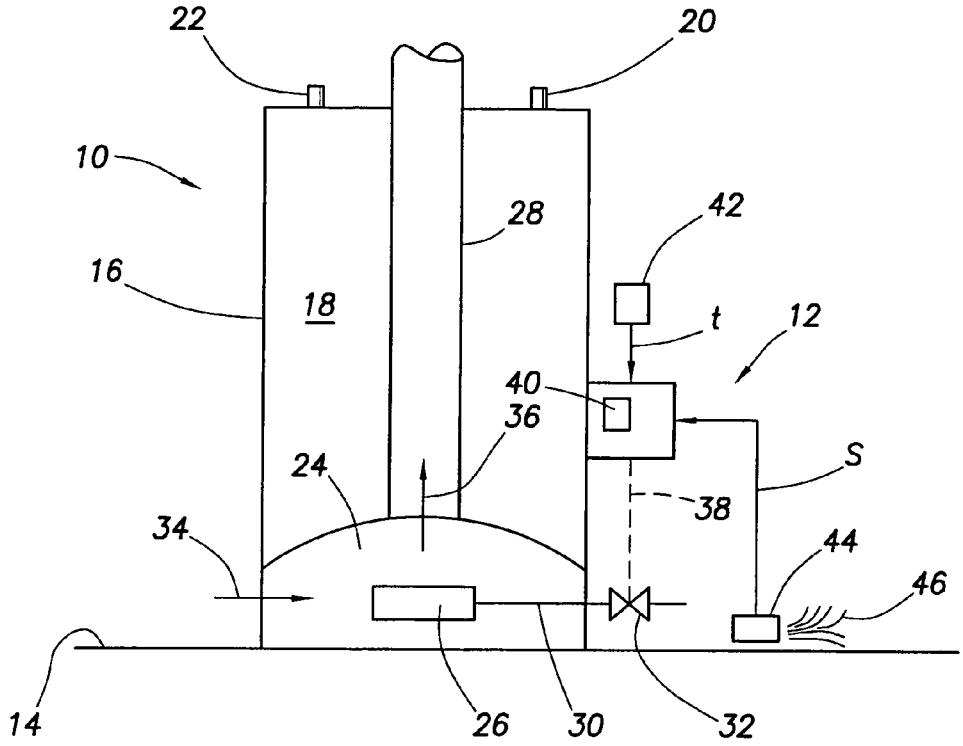
FIG. 1 schematically depicts a representative fuel-fired water heater incorporating a specially designed flammable vapor sensor-based combustion shut-off system embodying principles of the present invention.

Schematically illustrated in FIG. 1 is a fuel-fired heating appliance, representatively a gas-fired water heater 10 having incorporated therein a specially designed gas sensor-based combustion shut-off system 12 embodying principles of the present invention. While a water heater is representatively shown, it will be readily appreciated by those of skill in this particular art that principles of the present invention are not limited to water heaters, but could alternatively be incorporated to advantage in other types of fuel-fired heating appliances such as, for example but not by way of limitation, boilers and furnaces.

Water heater 10 is illustratively supported on a floor 14 and includes an insulated tank structure 16 in which a quantity of pressurized, heated water 18 is stored for on-demand delivery to various plumbing fixtures such as sinks, showers, tubs, dishwashers and the like through an outlet fitting 20 on the top end of the tank 16. Hot water 18 discharged from the tank 16 is replaced with pressurized cold water, from a source thereof, through an inlet fitting 22 also mounted on the top end of the tank 16.

The tank 16 overlies a combustion chamber 24 at the bottom end of the water heater. A fuel burner 26 is operatively disposed within the combustion chamber 24 beneath the open bottom end of a flue 28 that communicates with the interior of the combustion chamber 24 and extends upwardly from the top side of the combustion chamber 24 through the interior of the tank 16. Fuel gas is supplied to the burner 26 through a supply line 30 in which a normally closed gas valve 32 is installed. During firing of the burner 26, fuel supplied to the burner 26 is mixed and combusted with combustion air 34 suitably delivered to the combustion chamber 24 to form hot combustion gases 36 which are flowed upwardly through the flue 28. Combustion heat from the gases 36 is transferred to the stored water 18 through the flue 28.

With continuing reference to FIG. 1, the combustion shut-off system 12 may be incorporated in the main control system (not shown) of the water heater 10 which cycles the firing of the burner 26 as called for by a sensed temperature of the water 18, or may be a separate control system associated with the water heater 10. System 12 is operatively linked to the gas supply valve 32, as schematically depicted by the dashed line 38, and includes a suitably pre-programmed microprocessor 40, an operational timer 42, and a chemiresistor type flammable vapor sensor 44.

The operational timer 42 is operative to output to the microprocessor 40 a time signal "t" which is indicative of the total cumulative time which has elapsed since the flammable vapor sensor 44 was installed on the water heater 10. The flammable vapor sensor 44 is suitably supported adjacent the floor 14 near the bottom end of the water heater 10 and is operative to detect flammable vapor 46 (such as, for example, fumes from spilled gasoline) at or near floor level.

Flammable vapor sensor 44 continuously outputs an electrical signal "s" which is indicative of the electrical resistance of the sensor 44. In a known manner, the magnitude of the resistance output signal "s" varies with the concentration of the flammable vapor 46 to which the sensor 44 is exposed. Specifically, the magnitude of the resistance output signal "s" increases with corresponding increases in such detected flammable vapor concentration.

As will now be described in conjunction with the schematic flow chart of FIG. 2, in a first embodiment thereof the system 12 uniquely utilizes the signals "t" and "s" to preclude combustion within the combustion chamber 24 when the concentration of the flammable vapor 46 adjacent the sensor 44 is within a predetermined range. Importantly, according to a key aspect of the present invention, the combustion shut-off accuracy of the sensor 44 (i.e., its preclusion of appliance combustion only when the sensed flammable vapor concentration is in the preset range thereof) is substantially maintained during its entire operational life despite the unavoidable progressive lessening (degradation) of its resistance output signal "s" for a given concentration of detected flammable vapor 46 due to "aging" of the sensor caused simply by the passage of time.

Figure 2:
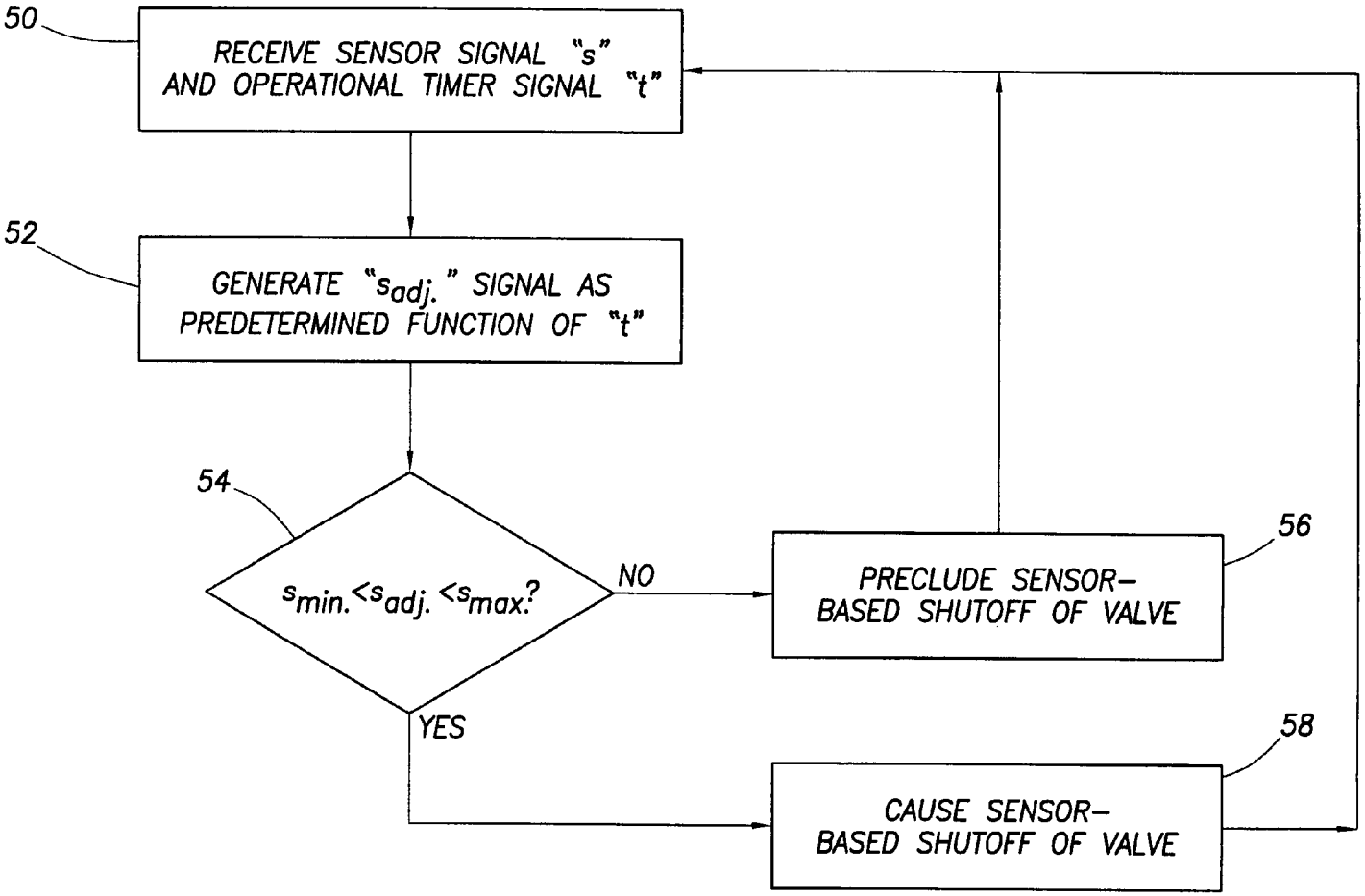
FIG. 2 is a schematic flow diagram illustrating a control technique incorporated in the combustion shut-off system.

Turning now to FIG. 2, in the initial step 50 of the combustion shut-off control technique provided by the system 12, the microprocessor 40 receives the sensor resistance output signal "s" and the operational timer output signal "t". In the next step 52, the microprocessor 50 generates an adjusted resistance signal "$s_{adj.}$" as a predetermined function of the cumulative time signal "t". The adjusted resistance signal "Sadj. " has a magnitude equal to the sum of the magnitude of the received signal "s" and the magnitude of a compensating resistance signal generated by the microprocessor (determined by a known relationship between the installed sensor time and its corresponding aging-based resistance loss) equal to the aging-based loss of the sensor 44).

Also pre-programmed into the microprocessor 40 is a predetermined range $s_{min.}$-$s_{max.}$ within which the signal "$s_{adj.}$" must fall for the system 12 to cause, via the operational link 38, the flammable vapor sensor-based shut-off of the gas supply valve 32. At the next step 54 a query is made as to whether the age-adjusted resistance signal "Sadj." is within the range $s_{min.}$-$s_{max.}$ If the answer is "NO", step 56 is performed to preclude the flammable vapor sensor-based shut-off of the valve 32. If the answer is "YES", step 58 is performed to cause the flammable vapor sensor-based shut-off of the valve 32.

In this manner, a predetermined relationship between the detected concentration of the flammable vapor 46 and the sensor-based shut-off of the valve 32 is advantageously maintained despite the degradation of the sensor resistance output signal "s" over time. Specifically, this predetermined relationship is that sensor-based shut-off of the valve 32 occurs during a detected flammable vapor concentration range having minimum and maximum magnitudes corresponding to the initial sensor resistance output signal minimum and maximum magnitude settings $s_{min}$. and $s_{max}$.

According to another feature of the present invention, in the foregoing embodiment thereof the predetermined value of $s_{min}$. is set within the range of from approximately 6 kΩ to approximately 10 kΩ, preferably at about 8 kΩ, and the predetermined value of $s_{max}$. is set within the range of from approximately 90 kΩ to about 110 kΩ, preferably at about 100 kΩ. This specially designed sensitivity range provides the system 12 with improved protection against nuisance tripping, while at the same time maintaining adequate responsiveness of the system. It will be appreciated, however, that the magnitudes of $s_{min}$. and $s_{max}$. could be set at other levels, if desired, without departing from principles of the present invention.

Figure 3:
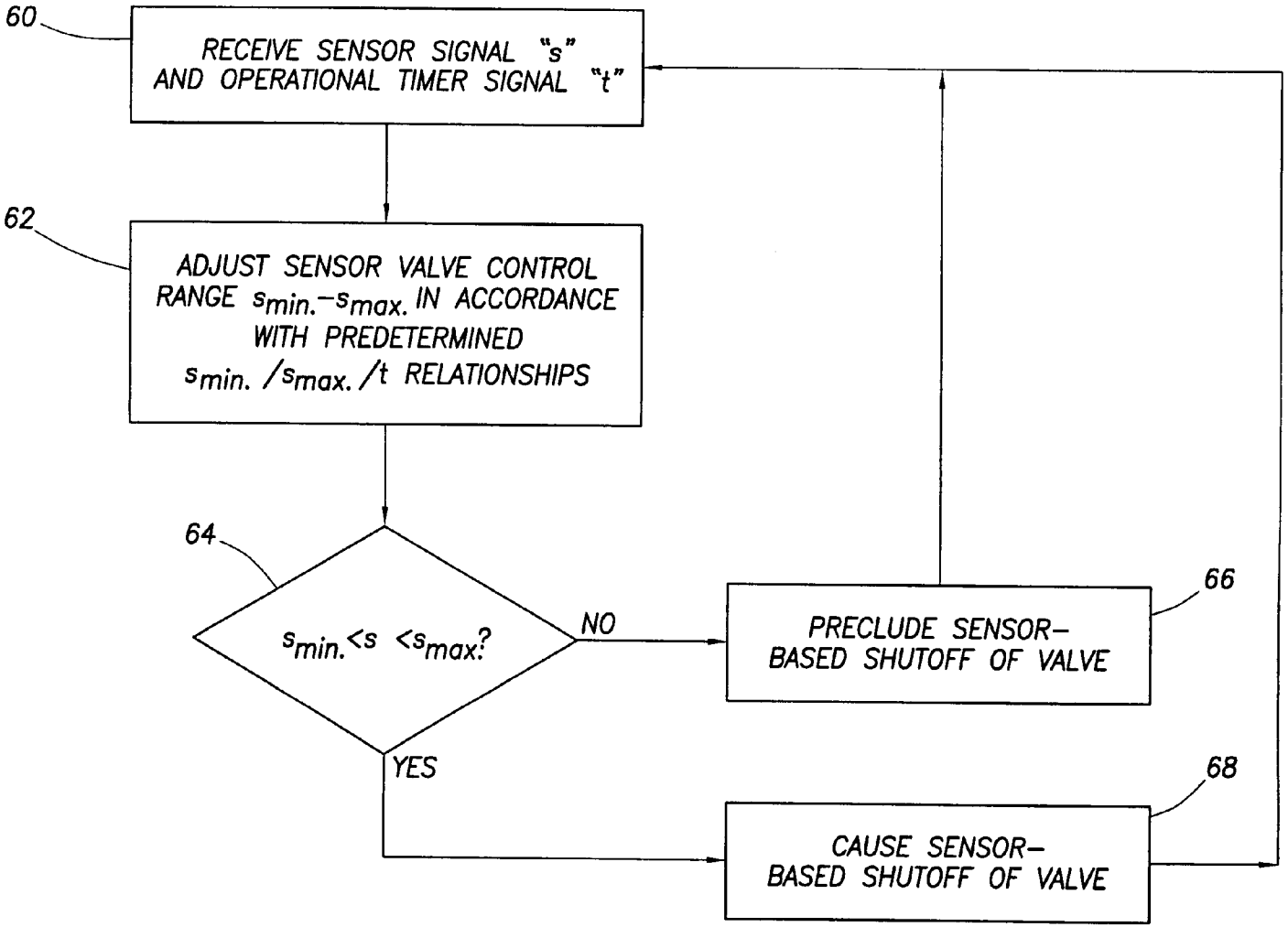
FIG. 3 is a schematic flow diagram illustrating an alternative control technique that may be incorporated in the combustion shut-off system.

The sensor-based combustion shut-off control technique of a second embodiment of the system 12 is schematically depicted in the flow chart of FIG. 3. In this embodiment of the system 12, the initial magnitudes of $s_{min}$. (within the range of from approximately 6 kΩ to approximately 10 kΩ, preferably about 8 kΩ), and $s_{max}$. (within the range of from approximately 90 kΩ to approximately 110 kΩ, preferably about 100 kΩ) are pre-programmed into the microprocessor 40. In the initial step 60 of the alternate FIG. 3 combustion shut-off control technique provided by the system 12, the microprocessor 40 receives the sensor resistance output signal "s" and the operational timer output signal "t". In the next step 62, the microprocessor 40 adjusts the sensor valve control range $s_{min}$-$s_{max}$. in accordance with a predetermined relationship between "t" and the sensor resistance output signals $s_{min}$. and $s_{max}$. (i.e., the known relationship between the cumulative installed life Of the flammable vapor sensor 44 and its age-based reduction in output signal strength). Since, with aging of the sensor 44, its output signal strength decreases, the range adjustment made by the microprocessor 40 would progressively decrease the values of $s_{min}$. and $s_{max}$. over time.

After the performance of step 62, a query is made at step 64 as to whether the received sensor resistance signal "s" is within the adjusted range $s_{min}$-$s_{max}$. If the answer is "NO", the process moves to step 66 which precludes sensor-based shut-off of the valve 32. If the answer is "YES", the process moves to step 68 which causes a sensor-based shut-off of the valve 32. As in the case of the previously described FIG. 2 control technique, using the FIG. 3 control technique a predetermined relationship between the detected concentration of the flammable vapor 46 and the sensor-based shut-off of the valve 32 is advantageously maintained despite the degradation of the sensor resistance output signal "s" over time.

While the sensor-based combustion shutoff system 12 has been representatively described as being operative to preclude appliance combustion by shutting off fuel supply to the burner 26, it will be readily be appreciated by those of skill in this particular art that the system 12 could alternatively be utilized, if desired, to instead shut off combustion air flow to the appliance, thereby terminating or precluding combustion in the appliance, without departing from principles of the present invention. Moreover, the system 12 could of course be utilized in conjunction with a shut-off sensor whose output signal increases as the sensor ages. Additionally, while the system 12 has been illustratively described as utilizing a chemiresistor type flammable vapor sensor 44, the system 12 could alternatively utilize a variety of other types of gas sensors, if desired, without departing from principles of the present invention.

Figure 4:
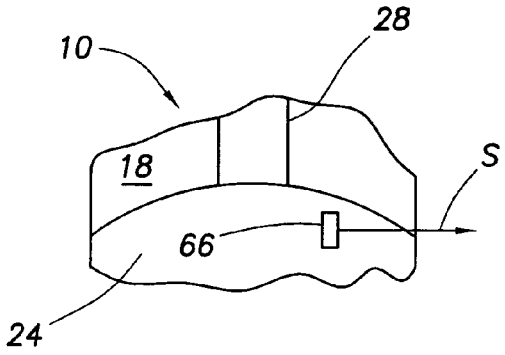
FIG. 4 is a view through a portion of the FIG. 1 water heater and illustrates an alternate type of gas sensor which may be incorporated in the combustion shut-off system.
Figure 5:
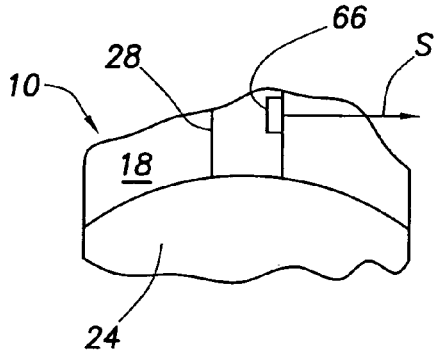
FIG. 5 is a view similar to that in FIG. 4 but indicating an alternate location for the FIG. 4 gas sensor.

For example, and not by way of limitation, as shown in FIGS. 4 and 5 a carbon monoxide sensor 66 could be utilized in the sensor-based combustion shut-off system 12 in place of the flammable vapor sensor 44, with the electrical output signal "s" of the sensor 66 (which may be an electrical resistance signal or another type of output signal which is degradable with aging of the sensor 66) being used instead of the output signal "s" of the flammable vapor sensor 44. The sensor 66 may be representatively located in the combustion chamber 24, as shown in FIG. 4, or in the flue 28 as shown in FIG. 5.

The foregoing detailed description is to be clearly understood as being given by way of illustration and example only, the spirit and scope of the present invention being limited solely by the appended claims.

What is claimed is:

1. For use in conjunction with a fuel-fired heating appliance having a combustion shut-off system in which a sensor generates an age-degradable output signal indicative of its detection of an undesirable gas and useable to preclude combustion in the appliance, a method of operating the combustion shut-off system, said method comprising the steps of:

providing a timer operable to output a time signal indicative of a total time the sensor has been operatively associated with the appliance; and utilizing the time signal to compensate for age-created inaccuracy in the sensor output signal.

2. The method of claim 1 wherein said utilizing step is performed using the steps of:

combining said time signal and said sensor output signal to create a time-adjusted sensor output signal, and utilizing said time-adjusted sensor output signal to preclude combustion in the appliance.

3. The method of claim 2 wherein:

the sensor is a flammable vapor sensor that generates an electrical resistance output signal, said time signal is an electrical signal, and said combining step is performed by combining said electrical signals.

4. The method of claim 2 wherein:

the sensor is a carbon monoxide sensor that generates an electrical output signal, said time signal is an electrical signal, and said combining step is performed by combining said electrical signals.

5. The method of claim 2 wherein:

the appliance has a fuel supply valve, and said step of utilizing said time-adjusted sensor output signal to preclude combustion in the appliance is performed by utilizing said time-adjusted sensor output signal to shut-off said fuel supply valve.

6. The method of claim 2 further comprising the step of:

setting minimum and maximum signal magnitudes between which the magnitude of said time-adjusted sensor output signal must fall to preclude combustion within the appliance.

7. The method of claim 6 wherein:

said time-adjusted sensor output signal is an electrical resistance signal, said minimum signal magnitude setting is within the range of from approximately 6 kΩ to approximately 10 kΩ, and said maximum signal magnitude setting is within the range of from approximately 90 kΩ to approximately 110 kΩ.

8. The method of claim 7 wherein:

said minimum signal magnitude setting is about 8 kΩ, and said maximum signal magnitude setting is about 100 kΩ.

9. The method of claim 1 further comprising the step of:

setting minimum and maximum signal magnitudes between which the magnitude of said age-degradable output signal must fall to preclude combustion within the appliance.

10. The method of claim 9 wherein:

said utilizing step is performed by utilizing said time signal to reset said minimum and maximum signal magnitudes as a function of the total time said sensor is operatively associated with the appliance.

11. The method of claim 9 wherein:

said age-degradable output signal is an electrical resistance signal, said minimum signal magnitude setting is within the range of from approximately 6 kΩ to approximately 10 kΩ, and said maximum signal magnitude setting is within the range of from approximately 90 kΩ to approximately 110 kΩ.

12. The method of claim 11 wherein:

said minimum signal magnitude setting is about 8 kΩ, and said maximum signal magnitude setting is about 100 kΩ.

13. The method of claim 10 wherein:

said age-degradable output signal is an electrical resistance signal, said minimum signal magnitude setting is within the range of from approximately 6 kΩ to approximately 10 kΩ, and said maximum signal magnitude setting is within the range of from approximately 90 kΩ to approximately 110 kΩ.

14. The method of claim 13 wherein:

said minimum signal magnitude setting is about 8 kΩ, and said maximum signal magnitude setting is about 100 kΩ.

15. A method of controlling a fuel-fired heating appliance having a fuel burner operative to create combustion within said appliance, said method comprising the steps of:

operably associating with the appliance a sensor operative to detect a presence of a predetermined substance and generate an output signal having a magnitude varying as a function of the concentration of the detected substance, the magnitude of said output signal for a given concentration of the detected substance changing as a function of a total time that said sensor has been operably associated with the appliance;

generating a time signal indicative of the total time said sensor is operably associated with the appliance;

utilizing said output signal to preclude combustion within the appliance; and using said time signal to compensate for sensor age-created changes in said output signal magnitude in a manner maintaining a predetermined relationship between the concentration of the detected substance and the sensor-based preclusion of combustion within the appliance.

16. The method of claim 15 wherein:

said operably associating step is performed using a flammable vapor sensor.

17. The method of claim 16 wherein:

said operably associating step is performed using a chemiresistor type flammable vapor sensor.

18. The method of claim 15 wherein:

said operably associating step is performed using a carbon monoxide sensor.

19. The method of claim 15 wherein:

the appliance is a fuel-fired water heater having a fuel supply valve, and said utilizing step is performed by closing said fuel supply valve.

20. The method of claim 15 wherein:

said using step includes the step of combining said time signal with said sensor output signal, and said utilizing step uses the combined time and sensor output signals to preclude combustion in the appliance.

21. The method of claim 15 further comprising the step of:

setting minimum and maximum signal magnitudes between which the magnitude of said sensor output signal must fall to preclude combustion within the appliance.

22. The method of claim 21 wherein:

said using step is performed by utilizing said time signal to reset said minimum and maximum signal magnitudes as a function of the total time said sensor is operatively associated with the appliance.

23. The method of claim 21 wherein:

said sensor output signal is an electrical resistance signal, said minimum signal magnitude setting is within the range of from approximately 6 kΩ to approximately 10 kΩ, and said maximum signal magnitude setting is within the range of from approximately 90 kΩ to approximately 110 kΩ.

24. The method of claim 23 wherein:

said minimum signal magnitude setting is about 8 kΩ and said maximum signal magnitude setting is about 100 kΩ.

25. The method of claim 22 wherein:

said sensor output signal is an electrical resistance signal, said minimum signal magnitude setting is within the range of from approximately 6 kΩ to approximately 10 kΩ, and said maximum signal magnitude setting is within the range of from approximately 90 kΩ to approximately 110 kΩ.

26. The method of claim 25 wherein:

said minimum signal magnitude setting is about 8 kΩ, and said maximum signal magnitude setting is about 100 kΩ.

* * * * *